US005656884A

United States Patent [19]

Lee

[11] Patent Number: 5,656,884

[45] Date of Patent: Aug. 12, 1997

[54] ELECTRON GUN OF A COLOR PICTURE TUBE FOR PREVENTING ASTIGMATION

[75] Inventor: Soo Keun Lee, Seoul, Rep. of Korea

[73] Assignee: Goldstar Co., Ltd., Seoul, Rep. of Korea

[21] Appl. No.: 300,334

[22] Filed: Sep. 2, 1994

[30] Foreign Application Priority Data

Sep. 4, 1993 [KR] Rep. of Korea ..... 17753/1993

[51] Int. Cl.[6] ..... H01J 29/56

[52] U.S. Cl. ..... 313/412; 313/414; 313/425; 313/428; 313/432

[58] Field of Search ..... 313/412, 414, 313/416, 425, 428, 432, 439, 458; 315/368.15

[56] References Cited

U.S. PATENT DOCUMENTS

| | | | |
|---|---|---|---|
| 4,086,513 | 4/1978 | Evans, Jr. | 313/458 X |
| 4,142,131 | 2/1979 | Ando et al. | 313/412 X |
| 4,208,610 | 6/1980 | Schwartz | 313/414 |
| 4,772,827 | 9/1988 | Osakabe | 313/414 |
| 5,017,843 | 5/1991 | Barten | 313/412 X |
| 5,128,586 | 7/1992 | Ashizaki et al. | 313/414 |

*Primary Examiner*—Sandra L. O'Shea
*Assistant Examiner*—Ashok Patel
*Attorney, Agent, or Firm*—Fish & Richardson PC

[57] ABSTRACT

An electron gun of a color picture tube which can make uniform beam spots on a screen by eliminating astigmation of electron beams caused by a self-convergence yoke is constructed by the use of the improved shapes of vertical blades or horizontal blades of astigmation correction electrodes. The electron gun includes a three electrode part having a plurality of in line electron beam emitting means for emitting electron beams, and control electrodes and an acceleration electrode for controlling the quantity of emission and forming a crossover of the electron beams, a plurality of focusing electrodes and positive electrodes forming a main electrostatic focusing lens for focusing the electron beam onto a screen, a four polar lens means having projections from forward ends on the four polar lens means positioned between a fixed voltage focusing electrode and a varying voltage focusing electrode, wherein the electron beam emitting means and the plurality of electrodes are in line with the tube axis spaced in a certain interval successively, said fixed voltage focusing electrode beam formed by applying a fixed voltage to at least one of the plurality of the focusing electrodes, and the varying voltage focusing electrode beam formed by applying varying voltage to at least one of the rest of the plurality of focusing electrodes.

6 Claims, 7 Drawing Sheets

ELECTRON GUN OF A COLOR PICTURE TUBE FOR PREVENTING ASTIGMATION

FIELD OF THE INVENTION

This invention relates to an electron gun of a color picture tube, more particularly to an electron gun which can make uniform beam spots on a screen by eliminating astigmation of electron beams caused by a self-convergence yoke through improvement of shapes of vertical blades or horizontal blades of astigmation correction electrodes.

DESCRIPTION OF THE PRIOR ART

As shown in FIG. 1, a prior art color picture tube includes three cathodes 2R, 2G and 2B for emitting electrons, an electron gun 4 for focusing each of the electron beams 3R, 3G and 3B emitted from the cathodes 2R, 2G and 2B, and a deflection yoke 6 for deflecting the electron beams toward periphery of a screen. The electron beams emitted from the cathodes make the fluorescent material coated on the screen inside of a panel luminous to obtain a desired color and image.

In this instant, the three electron beams 3R, 3G and 3B directed to meet at the center of the screen 5 deflect to the periphery, but due to increased distance of travel of the three beams, the three electron beams can not be met on a same spot as shown in FIG. 2. Therefore, to correct this, a magnetic field generated at the deflection yoke 6 forms a magnetic field as shown in FIGS. 3*a* and 3*b*. That is, a self-convergence yoke is provided that applies a magnetic field having equivalent lines of magnetic force 7 formed in a pin-cushion shape in horizontal direction as shown in FIG. 3*a* and in barrel shape in vertical direction as shown in FIG. 3*b*. However, this self-convergence yoke diverges an electron beam spot 3 in horizontal direction and converges it in vertical direction as shown in FIG. 4, which makes the electron beam spot 3 exhibit a serious astigmation at the periphery of the screen.

Therefore, a dynamic astigmation correction type electron gun 4 as shown in FIG. 5 is used for eliminating the astigmation due to the self-convergence yoke. In the electron gun, electron beams emitted from cathodes pass a first grid electrode 9 and a second grid electrode 10, and are focused at the center of a screen by a main electrostatic focusing lens formed of focusing electrodes 11 and an acceleration electrode 12. In this instant, a constant voltage is applied to a first focusing electrode 13 of the focusing electrodes 11, and a varying voltage synchronized to deflection is applied to a second focusing electrode 14 adjacent to the acceleration electrode 12 of the focusing electrodes 11. And the first focusing electrode 13 and the second focusing electrode 14 has vertical blade electrodes 21 and horizontal blade electrodes 31 to correct the astigmation forming at periphery of the screen caused by the self-convergence yoke.

As shown in a detail drawing of FIG. 6, in general, the first focusing electrode 13 includes vertical blade electrodes 21, a supporting electrode 22 for supporting the vertical electrodes, and a cap part 23 and a cup part 24, of the first focusing electrode for accommodating the aboves, and the second focusing electrode 14 includes in general horizontal blade electrodes 31, and a cup part 34 and cap part 33, of the second focusing electrode for supporting the above. Of course, it is possible to attach the horizontal blade electrode 31 to the second focusing electrode cup part directly, since the horizontal blade is supported on the horizontal blade supporting electrode.

In such a prior art dynamic astigmation correction type electron gun, when a magnetic field is not formed by the deflection yoke 6 leaving electron beams to direct at the center of the screen, since the voltage applied to the second focusing electrode 14 is the same with the voltage applied to the first focusing electrode 13 no electrostatic lens by an electric field is formed between the vertical blade electrodes and the horizontal blade electrodes. When a magnetic field is formed by the deflection yoke 6, the voltage applied to the second focusing electrode 14 is made higher than the voltage applied to the first focusing electrode 13 to form a four polar focusing lens between the vertical blade electrodes and the horizontal blade electrodes to make the electron beams converged in horizontal direction and diverged in vertical direction as shown in FIG. 7 to correct the astigmation caused by the self-convergence yoke.

However, in the prior art described above, for electrical insulation of the vertical blade electrodes on the first focusing electrode and the horizontal blade electrodes on the second focusing electrode, the electrodes are positioned spaced apart to a certain distance along the center line of each electron beam. Accordingly, intensity of the electric field formed between these electrodes as well as the intensity of the astigmation correction four polar lens is weakened significantly. Consequently, there has been difficulty in fabricating the circuit because the voltage applied to the horizontal blade electrodes should be significantly higher than the voltage applied to the vertical blade electrodes to correct the astigmation caused by the self-convergence yoke.

SUMMARY OF THE INVENTION

The object of this invention for solving the foregoing problems is to provide an electron gun of a color picture tube which can correct horizontal and vertical direction astigmation caused by a self-convergence yoke by reducing the distance between the horizontal blade electrodes and the vertical blade electrodes used for correction of the astigmation which can form a strong four polar lens even under low voltage.

These and other objects and features of this invention can be achieved by providing an electron gun of a color picture tube including a three electrode part having a part formed of a plurality of inline electron beam emitting means for emitting electron beams and the other part formed of control electrodes and an acceleration electrode for controlling quantity of emission and forming a crossover of the electron beams, a plurality of focusing electrodes and positive electrodes forming a main electrostatic focusing lens for focusing the electron beam onto a screen, a four polar lens means having projections from forward ends thereon positioned between a fixed voltage focusing electrode and a varying voltage focusing electrode, wherein the electron beam emitting means and the plurality of electrodes are aligned in line with the tube axis spaced in a certain interval successively, said fixed voltage focusing electrode is formed by applying a fixed voltage to at least one of the plurality of the focusing electrodes, and said varying voltage focusing electrode is formed by applying a varying voltage to at least one of the rest of the plurality of focusing electrodes. Alternatively, the four polar lens means may includes a first, and a second four polar lens means positioned between a fixed voltage focusing electrode and a varying voltage focusing electrode, said first four polar lens means is vertical blade electrodes attached at both sides of an electron beam passing hole in vertical direction on the fixed voltage focusing electrode facing the varying voltage focusing electrode, and the second four polar lens means is a common opening for passing the plurality of electron beams facing the vertical blade electrodes at the center.

BRIEF DESCRIPTION OF THE DRAWINGS

In the accompanying drawings:

FIGS. 3*a* to 3*b* show a magnetic field generated by prior art deflection yoke, wherein FIG. 3*a* shows a pin-cushion type magnetic field in horizontal direction.

FIG. 3*b* shows a barrel type magnetic field in vertical direction.

FIGS. 13*a* and 13*b* are comparisons of voltages for prior art and this invention, wherein FIG. 13*a* is a graph showing required maximum voltages.

FIG. 13*b* is a graph showing voltage difference for horizontal varying voltage and vertical varying voltage.

DETAILED DESCRIPTION OF THE EMBODIMENT

Embodiments of this invention is to be explained hereinafter, referring to attached drawings.

Figure 8:
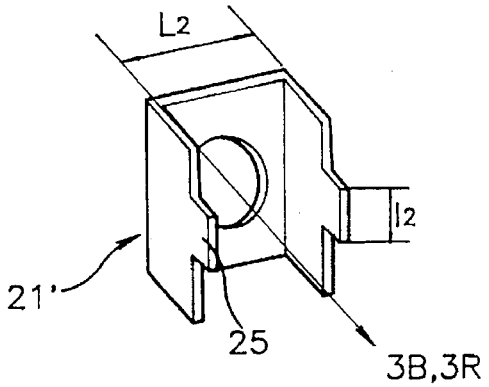
FIG. 8 is an enlarged perspective view of vertical blade electrodes for first astigmation correction in accordance with this invention.

Shown in FIG. 8 is detail of a vertical blade electrodes in accordance with this invention. As shown in the drawing, the vertical blade electrode includes two vertical blade electrodes 21' bent toward a horizontal blade electrode and a projection 25 provided at a forward end of each of the vertical blade electrodes. And the length 12 of the projection is formed shorter than a distance L1 to a horizontal blade electrode.

Figure 9:
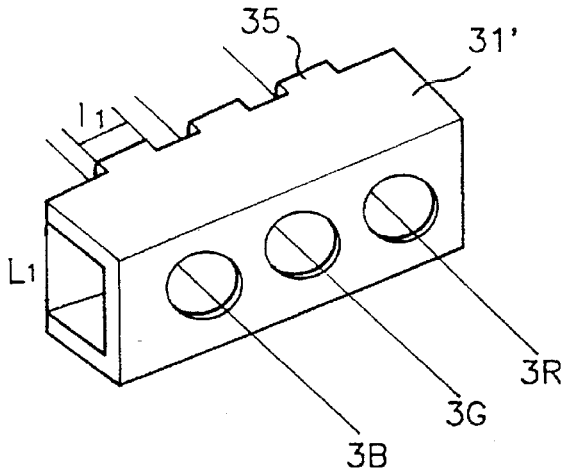
FIG. 9 is an enlarged perspective view of horizontal blade electrodes for second astigmation correction in accordance with this invention.

Shown in FIG. 9 is detail of horizontal blade electrodes in accordance with this invention. As shown in the drawing, the horizontal blade electrode includes two horizontal blade electrodes 31' bent toward the vertical blade electrodes and a projections 35 provided at the end of each of the horizontal blade electrodes. And the length of the projection 11 is formed shorter than distance to a horizontal blade electrode L2.

Figure 10:
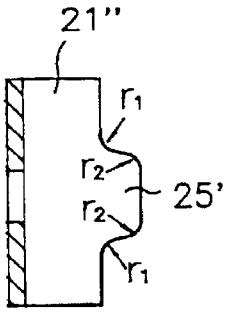
FIG. 10 is vertical blade electrodes in accordance with other embodiment of this invention.

Shown in FIG. 10 is detail of vertical blade electrodes in accordance with other embodiment of this invention. As shown in the drawing, the projection 25' of the vertical blade electrode 21" has rounded corners with a radius r2 centered at any point within the vertical blade electrode and a radius r1 centered at any point outside of the vertical blade electrode to form a first astigmation correction electrode. 0r alternatively, the projections on each of the horizontal electrode may have the radii as above to form a second astigmation correction electrode.

Figure 11A:
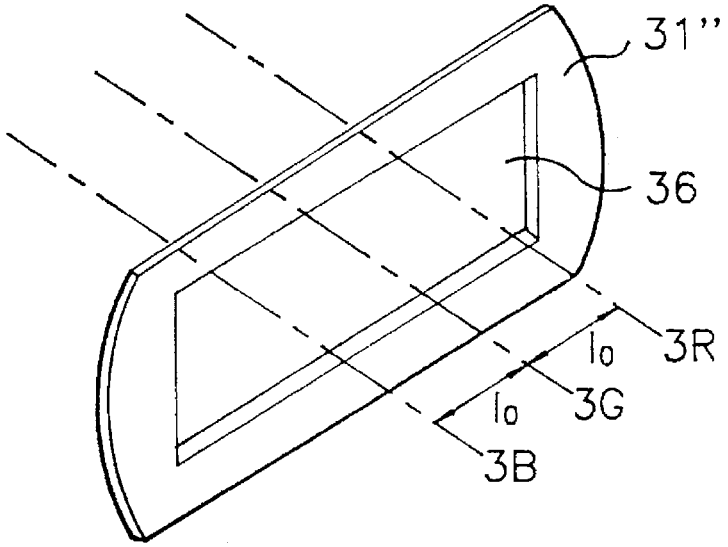
FIGS. 11*a* and 11*b* are horizontal blade electrodes in accordance with other embodiment of this invention.
Figure 11B:
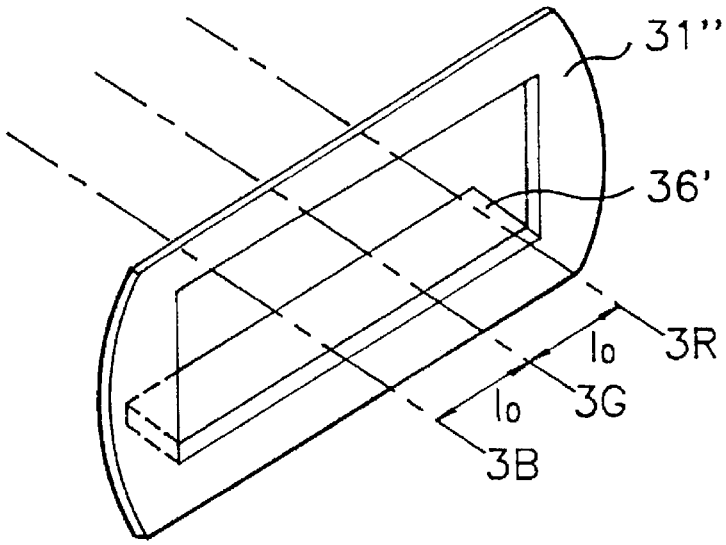

Shown in FIGS. 11*a* and 11*b is* detail of horizontal blade electrodes in accordance with other embodiment of this invention. As shown in the drawing, a common opening 36 is formed for passing the three electron beams travelling maintaining a fixed distance lo to the vertical planes of the horizontal blade electrodes or the vertical blade electrodes to the axes of the electron beams to form a second astigmation correction horizontal blade. And the common opening 36 may be provided with a partial projection 36' toward another side electrode.

Figure 12:
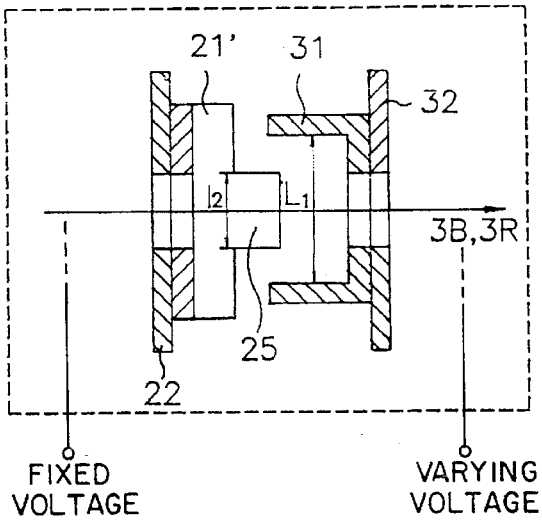
FIG. 12 is a section showing assembly of the vertical blade electrodes, the horizontal blade electrodes and the supporting parts.

Shown in FIG. 12 is a section of assembly of the astigmation correction electrodes in accordance with this invention. As shown in the drawing, the assembly is carried out by joining of the vertical (or horizontal) blade electrodes having the projections.

And the astigmation correction electrode may be formed by joining the first astigmation electrodes and the second astigmation electrodes both of them having the projections (not shown).

Operation and advantage of this invention of the foregoing description is to be explained hereinafter.

Figure 1:
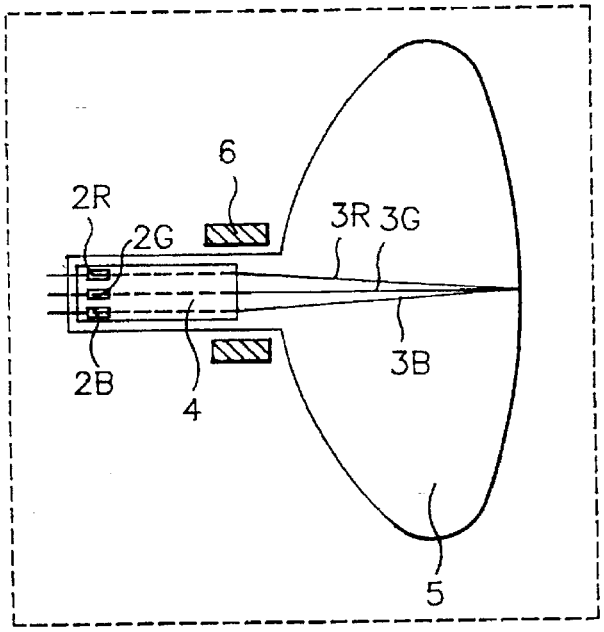
FIG.1 PRIOR ART
FIG. 1 is a section of a general color picture tube.
Figure 2:
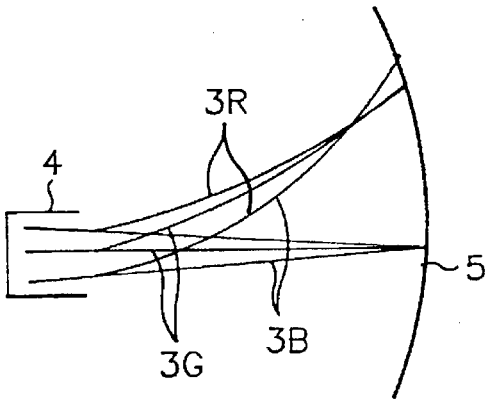
FIG.2 PRIOR ART
FIG. 2 shows prior art electron beam paths due to deflection force.
Figure 3A:
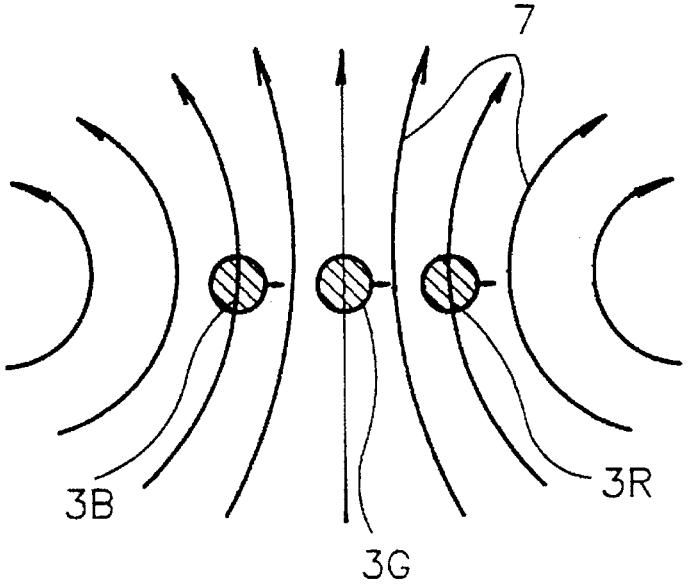
FIG.3a PRIOR ART
Figure 3B:
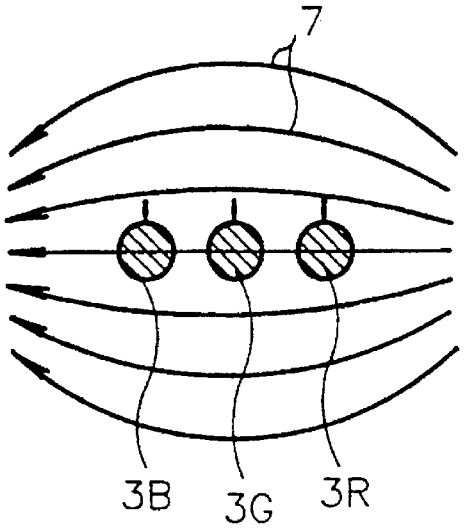
FIG.3b PRIOR ART
Figure 4:
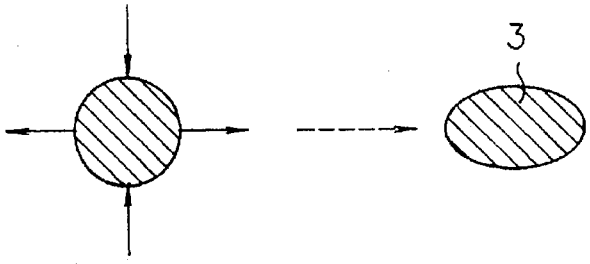
FIG.4 PRIOR ART
FIG. 4 is enlarged views of an electron beam spot on a screen formed by a prior art self-convergence yoke.
Figure 5:
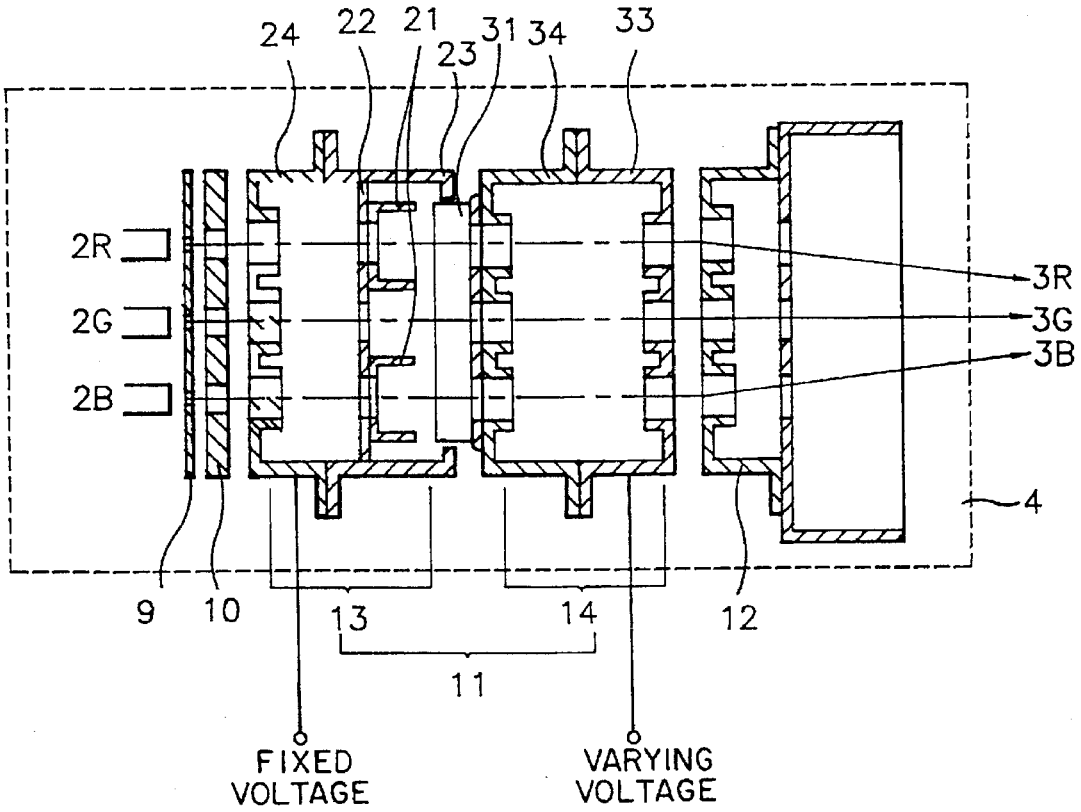
FIG.5 PRIOR ART
FIG. 5 is a section of a prior art dynamic astigmation correction type electron gun.
Figure 6:
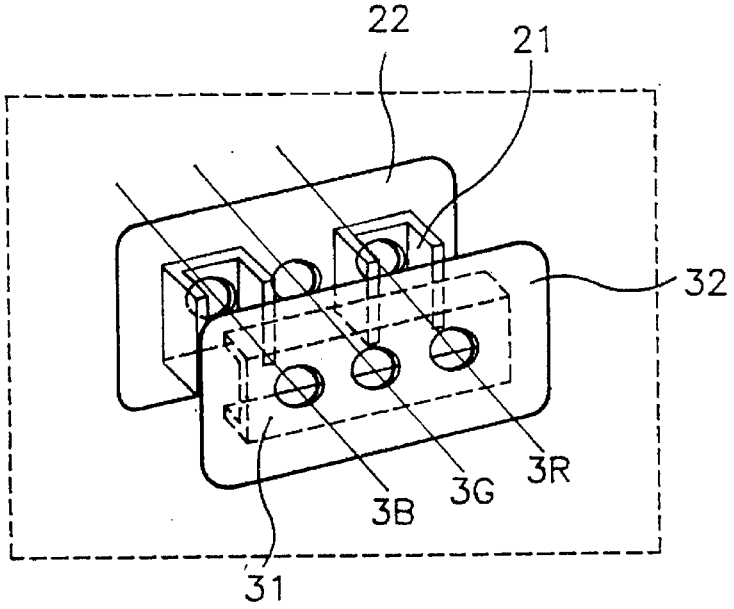
FIG.6 PRIOR ART
FIG. 6 is an enlarged perspective view of a prior art dynamic astigmation correction electrode.
Figure 7:
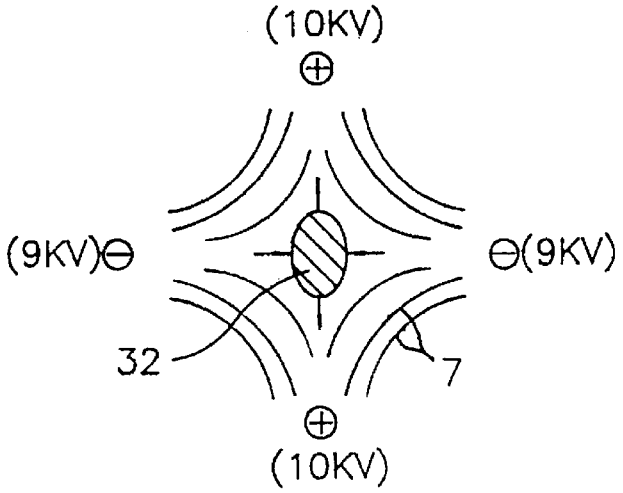
FIG.7 PRIOR ART
FIG. 7 shows an electron beam spot in magnetic lines formed by general four polar lens.

First, a fixed voltage or a varying voltage synchronized to deflection signal is applied to the vertical blade electrodes 21' each having the projection 25 and a varying voltage synchronized to deflection signal is applied to the horizontal blade electrodes 31' each having the projections 35, to operate the electron gun. In this instant, in case voltages at a moment applied to the vertical blade electrodes 21' and the horizontal blade electrodes 31' having come closer in distance are compared, the voltage applied to the horizontal blade electrodes 31' is the same with or higher than the voltage applied to the vertical blade electrodes 21'. For example, when a high voltage such as 10 KV is applied to the horizontal blade electrodes 31' and a relatively low voltage, such as 9 KV is applied to the vertical blade electrodes 21', due to the voltage difference between the electrodes equipotential lines centered at the electron beam are formed as shown in FIG. 7, and the electron beam passing this center is to have diverging force exerted in vertical direction and converging force exerted in horizontal direction.

The electron beam distorted in horizontal and vertical directions as above can be focused at the screen maintaining a proper convergence owing to the self-convergence yoke which exerts a converging force in vertical direction and a diverging force in horizontal direction.

In this instant, in case the electron beams are focused at the center of the screen, since no astigmation due to the self-convergence magnetic field will be developed, the four polar lens effect due to the astigmation correction electrodes is eliminated by applying same voltages to the vertical blade electrodes 21' and horizontal blade electrodes 31'.

Figure 13A:
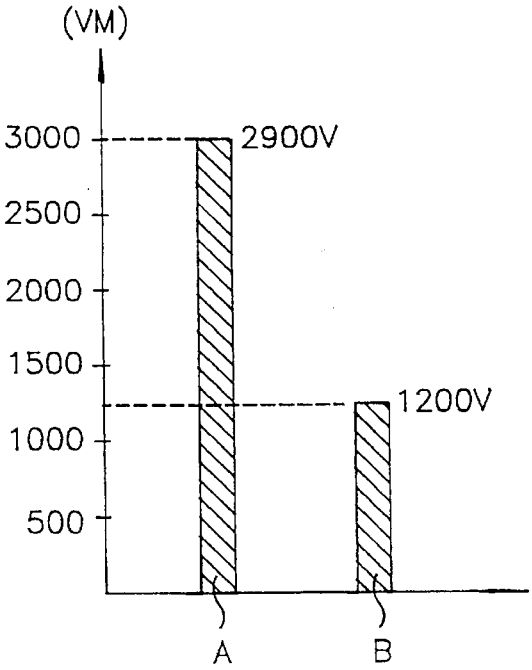

That is as shown in FIG. 13*a*, for the maximum varying voltage VM for forming focus of the electron beams at the periphery of the screen, in case of A using prior art astigmation correction electrodes, a high varying voltage of 2900 V is required due to longer distance between the electrodes, and in case of B using the astigmation correction electrodes the distance between the electrodes made shorter by forming projections at the vertical blade electrodes or the horizontal blade electrodes, a low varying voltage of 1200 V is required.

Figure 13B:
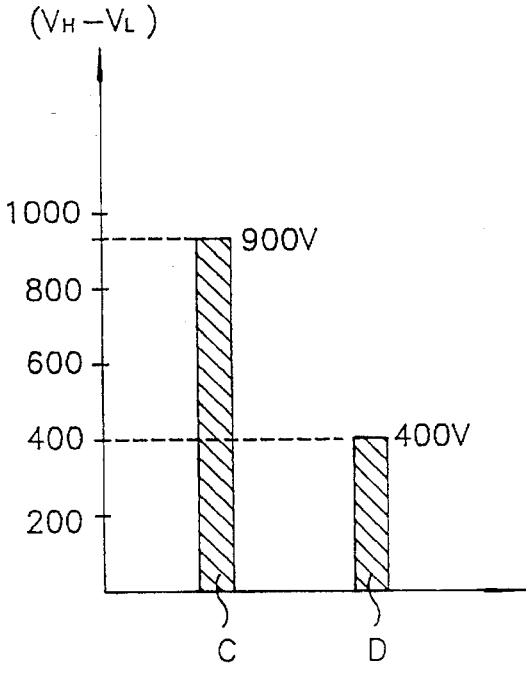

As shown in FIG. 13*b* for the difference of voltages VH–VL between the horizontal varying voltage VH for forming the focus in horizontal direction and the vertical varying voltage VL for forming the focus in vertical direction for the electron beams, in case of C using the astigmation correction electrode having comparatively far distance between the electrodes, a high voltage of 900 V is required and in case of D using the astigmation correction electrodes made the distance between the electrodes shorter by forming the projections, a comparatively low varying voltage of 400 V is required. And if the varying voltages in horizontal and vertical directions are the same i.e., the voltage difference is zero, it is possible to form the electron beam spots small and uniform with the astigmation correction electrodes in accordance with this invention because the focus can be formed in horizontal and vertical directions on the same time at a particular voltage.

As has been explained this invention facilitates to correct horizontal and vertical direction astigmation by improving the four polar lens formed of a astigmation correction electrodes through forming projections at vertical blade electrodes and/or horizontal electrodes of a astigmation correction electrodes.

Although the invention has been described in conjunction with specific embodiments it is evident that many alternatives and variations will be apparent to those skilled in the art in light of the foregoing description. Accordingly the invention is intended to embrace all of the alternatives and variations that fall within the spirit and scope of the appended claims.

What is claimed is:

1. An electron gun of a color picture tube comprising:

a three electrode part having a part formed of a plurality of in line electron beam emitting means for emitting electron beams and the other part formed of control electrodes and an acceleration electrode for controlling the quantity of emission and forming a crossover of the electron beams;

a plurality of focusing electrodes forming a main electrostatic focusing lens for focusing the electron beam onto a screen;

a fixed voltage focusing electrode formed by applying a fixed voltage to at least one of said plurality of the focusing electrodes, and a varying voltage focusing electrode formed by applying a varying voltage to at least one of the rest of said plurality of focusing electrodes; and, a four polar lens means positioned between a fixed voltage focusing electrode and a varying voltage focusing electrode and including supplemental electrodes positioned on the circumference of an electron beam passing hole on said voltage focusing electrodes and projections from forward ends on said supplemental electrodes, said projections having narrower widths than the widths of said supplemental electrodes and approaching an overlapping position with or overlapping with said supplemental electrodes while maintaining electrical insulation with said voltage focusing electrode;

wherein the electron beam emitting means and the plurality of electrodes are aligned in line with the tube axis spaced in a certain interval successively.

2. The electron gun as claimed in claim 1, wherein the supplemental electrodes are vertical blade electrodes positioned on both sides of an electron beam passing hole on the fixed voltage focusing electrode, and horizontal blade electrodes positioned on top and bottom of an electron beam passing hole on the varying voltage focusing electrode, wherein the vertical and the horizontal blades are maintained insulated and positioned opposite to each other at the center, and at least either one of the vertical blade electrodes and the horizontal blade electrodes has partial projections from the forward ends of the blades toward other electrodes.

3. The electron gun as claimed in claim 2, wherein each of the projections is formed of a combination of straight lines.

4. The electron gun as claimed in claim 2, wherein each of the projections is formed of a combination of arcs.

5. An electron gun of a color picture tube comprising:

a three electrode part having a part formed of a plurality of in line electron beam emitting means for emitting electron beams and the other part formed of control electrodes and an acceleration electrode for controlling quantity of emission and forming a crossover of the electron beams;

a plurality of focusing electrodes forming a main electrostatic focusing lens for focusing the electron beam onto a screen; and first and second four polar lens means positioned between a fixed voltage focusing electrode and a varying voltage focusing electrode, said first four polar lens means comprising vertical blade electrodes positioned at both sides of an electron beam passing hole in vertical direction on the fixed voltage focusing electrode facing the varying voltage focusing electrode, and said second four polar lens means comprising a common opening for passing the plurality of electron beams facing the vertical blade electrodes at the center;

wherein the electron beam emitting means and the plurality of electrodes are aligned in line with the tube axis spaced in a certain interval successively, said fixed voltage focusing electrode is formed by applying a fixed voltage to at least one of the plurality of the focusing electrodes, and said varying voltage focusing electrode is formed by applying a varying voltage to at least one of the rest of the plurality of focusing electrodes.

6. The electron gun as claimed in claim 5, wherein the common opening has a partial projection toward other electrode.

* * * * *